US005495317A

United States Patent [19]

Matsuda et al.

[11] Patent Number: 5,495,317

[45] Date of Patent: Feb. 27, 1996

[54] IMAGE TRANSFER DEVICE FOR AN IMAGE FORMING APPARATUS

[75] Inventors: Itaru Matsuda, Yokohama; Satoshi Takano, Tokyo; Yuko Harasawa, Hayama, all of Japan

[73] Assignee: Ricoh Company, Ltd., Tokyo, Japan

[21] Appl. No.: 373,893

[22] Filed: Jan. 17, 1995

Related U.S. Application Data

[63] Continuation of Ser. No. 46,795, Apr. 16, 1993, abandoned.

[30] Foreign Application Priority Data

Apr. 20, 1992 [JP] Japan ..... 4-099928
Jun. 1, 1992 [JP] Japan ..... 4-140590

[51] Int. Cl.[6] ..... G03G 21/00

[52] U.S. Cl. ..... 355/208; 355/274; 355/275

[58] Field of Search ..... 355/208, 271, 355/273, 274, 275

[56] References Cited

U.S. PATENT DOCUMENTS

| | | | |
|---|---|---|---|
| 3,832,053 | 8/1974 | Goel et al. | 355/274 |
| 4,338,017 | 7/1982 | Nishikawa | 355/272 |
| 4,407,580 | 10/1983 | Hashimoto et al. | 355/275 |
| 4,916,547 | 4/1990 | Katsumata et al. . | |
| 4,984,024 | 1/1991 | OPhkaji et al. . | |
| 5,172,173 | 12/1992 | Goto et al. | 355/275 |
| 5,189,479 | 2/1993 | Matsuda et al. . | |
| 5,198,863 | 3/1993 | Goto et al. | 355/274 |
| 5,268,717 | 12/1993 | Imaizumi | 355/275 X |
| 5,291,253 | 3/1994 | Kumasaka et al. | 355/275 |

FOREIGN PATENT DOCUMENTS

| | | | |
|---|---|---|---|
| 4040962 | 6/1991 | Germany . | |
| 0024683 | 1/1990 | Japan | 355/275 |
| 0182787 | 8/1991 | Japan | 355/275 |
| 0186876 | 8/1991 | Japan | 355/275 |
| 0231274 | 10/1991 | Japan | 355/275 |
| 2065558 | 7/1981 | United Kingdom . | |

*Primary Examiner*—Robert Beatty
*Attorney, Agent, or Firm*—Oblon, Spivak, McClelland, Maier & Neustadt

[57] ABSTRACT

An image transfer device for a copier, printer, facsimile apparatus or similar image forming apparatus. A transfer belt is rotated and applied with a charge from a first electrode in contact with the transfer belt to transfer a toner image from an image carrier to a transfer medium carried on the transfer belt or to the transfer belt itself. A second electrode contacts the transfer belt. A variable resistance element is connected between the second electrode and ground. A controller produces a ratio of a current applied from the first electrode to the transfer belt and a current from the transfer belt to the second electrode and controls a resistance of the variable resistance element such that the ratio has a predetermined value. Additionally, the resistance of the transfer belt to the variable resistance element is one of 1:1–100, 10:1–100 and 100:1–100.

13 Claims, 9 Drawing Sheets

Fig. 2

| BELT RESISTANCE | | $10^8\ \Omega$ | $10^7\ \Omega$ | $10^6\ \Omega$ |
|---|---|---|---|---|
| WITHOUT RESISTANCE | $V_1$ | 3000V | 3000V | 3000V |
| | $A_1$ | 30 μA | 300 μA | 3 mA (LEAK OCCURRED) |
| | $A_2$ | 15 μA | 280 μA | UNUSABLE |
| | $A_3\ (A_1-A_2)$ | 15 μA | 20 μA | UNUSABLE |
| WITH RESISTANCE ($10^7\ \Omega$) | $V_1$ | 3000V | 3000V | 3000V |
| | $A_1$ | 30 μA | 150 μA | 300 μA |
| | $A_2$ | 15 μA | 130 μA | 275 μA |
| | $A_3\ (A_1-A_2)$ | 15 μA | 20 μA | 25 μA |

Fig. 6

| | BELT RESISTANCE | $10^8\Omega$ | $10^7\Omega$ | $10^6\Omega$ |
|---|---|---|---|---|
| WITHOUT RESISTANCE | $A_1$ | 40 μA | 200 μA | 520 μA |
| | $A_2$ | 20 μA | 180 μA | 500 μA |
| | $A_3(A_1-A_2)$ | 20 μA | 20 μA | 20 μA |
| | $V_1$ | 4000V | 2000V | 520V |
| WITH RESISTANCE ($10^7\Omega$) | $A_1$ | 40 μA | 120 μA | 200 μA |
| | $A_2$ | 20 μA | 100 μA | 180 μA |
| | $A_3(A_1-A_2)$ | 20 μA | 20 μA | 20 μA |
| | $V_1$ | 4000V | 2400V | 2000V |

IMAGE TRANSFER DEVICE FOR AN IMAGE FORMING APPARATUS

This application is a continuation of application Ser. No. 08/046,795, filed on Apr. 16, 1993, now abandoned.

BACKGROUND OF THE INVENTION

The present invention relates to an image transfer device for a copier, printer, facsimile apparatus or similar image forming apparatus.

In an apparatus of the type described, an image transfer device transfers a toner image formed on a photoconductive element, or image carrier, to a sheet or similar transfer medium. A predominant type of image transfer device has a corona discharger and transfers a toner image from a photoconductive element to the front of a transfer medium by effecting corona discharge at the rear of the medium. In addition to such a corona type device, a contact type image transfer device has been proposed which holds an electrode in contact with a transfer belt and applies a charge to the belt from a power source via the electrode to thereby transfer a toner image from a photoconductive element to a transfer medium carried on the belt or to the belt.

Regarding the contact type image transfer device, Japanese Patent Laid-Open Publication No. 231274/1991 proposes to control the output current from the transfer belt to the photoconductive element by detecting a current fed back to the belt. Japanese Patent Laid-Open Publication No. 83762/1988 uses a transfer belt whose specific volume resistance is $10^{10}$–$10^{13}$ Ω and causes the belt to hold a charge at an image transfer position and causes a conductor to discharge the belt at a medium separating position. Further, Japanese Patent Laid-Open Publication No. 96838/1978 uses a transfer belt whose specific volume resistance is $10^{8}$–$10^{13}$ Ω and discharges the belt in between adjoining photoconductive drums playing the role of color toner image carriers.

The contact type image transfer device reduces ozone and required power source voltage, compared to the corona type device. However, the problem with the transfer belt is that an adequate voltage to be applied from the power source to the belt changes due to irregularity in the resistance of the belt and changes in environment, transfer medium type, area of the toner image and so forth, obstructing adequate image transfer. Specifically, the amount of charge to deposit on the belt in response to the voltage from the power source deviates from a value necessary for adequate image transfer due to irregularity in the resistance of the belt particular to the production line, changes in the resistance ascribable to the varying environment, changes in the material and thickness of the recording medium, etc. Among them, the changes in the resistance of the belt ascribable to the production line and environment may be reduced by elaborating the production line. This, however, severely restricts the specifications and, therefore, reduces the yield and increases the cost of the belt. It follows that an image transfer device desirably operable despite some irregularity in the resistance of the belt is needed. Particularly, when the resistance of the belt is lowered, a greater current flows to ground via a drive roller and other rollers contacting the belt than to the drum via the electrodes, obstructing desirable image transfer.

SUMMARY OF THE INVENTION

It is therefore an object of the present invention to provide an image transfer device for an image forming apparatus which insures stable image transfer.

In accordance with the present invention, in an image transfer device in which a transfer belt is rotated and applied with a charge from a first electrode in contact with the transfer belt to transfer a toner image from an image carrier to a transfer medium carried on the transfer belt or to the transfer belt, a second electrode contacts the transfer belt, and a resistance element is connected between the second electrode and ground.

BRIEF DESCRIPTION OF THE DRAWINGS

The above and other objects, features and advantages of the present invention will become more apparent from the following detailed description taken with the accompanying drawings in which:

FIG. 2 is a table comparing the first embodiment and a conventional contact type image transfer device with respect to a voltage from a high tension power source and various currents changing with the rear surface resistance of a transfer belt;

FIG. 6 is a table similar to the table of FIG. 2, comparing the fourth embodiment and the conventional device;

In the figures, the same or similar constituents are designated by the same reference numerals, and a detailed description will not be made to avoid redundancy.

DESCRIPTION OF THE PREFERRED EMBODIMENTS

Figure 1:
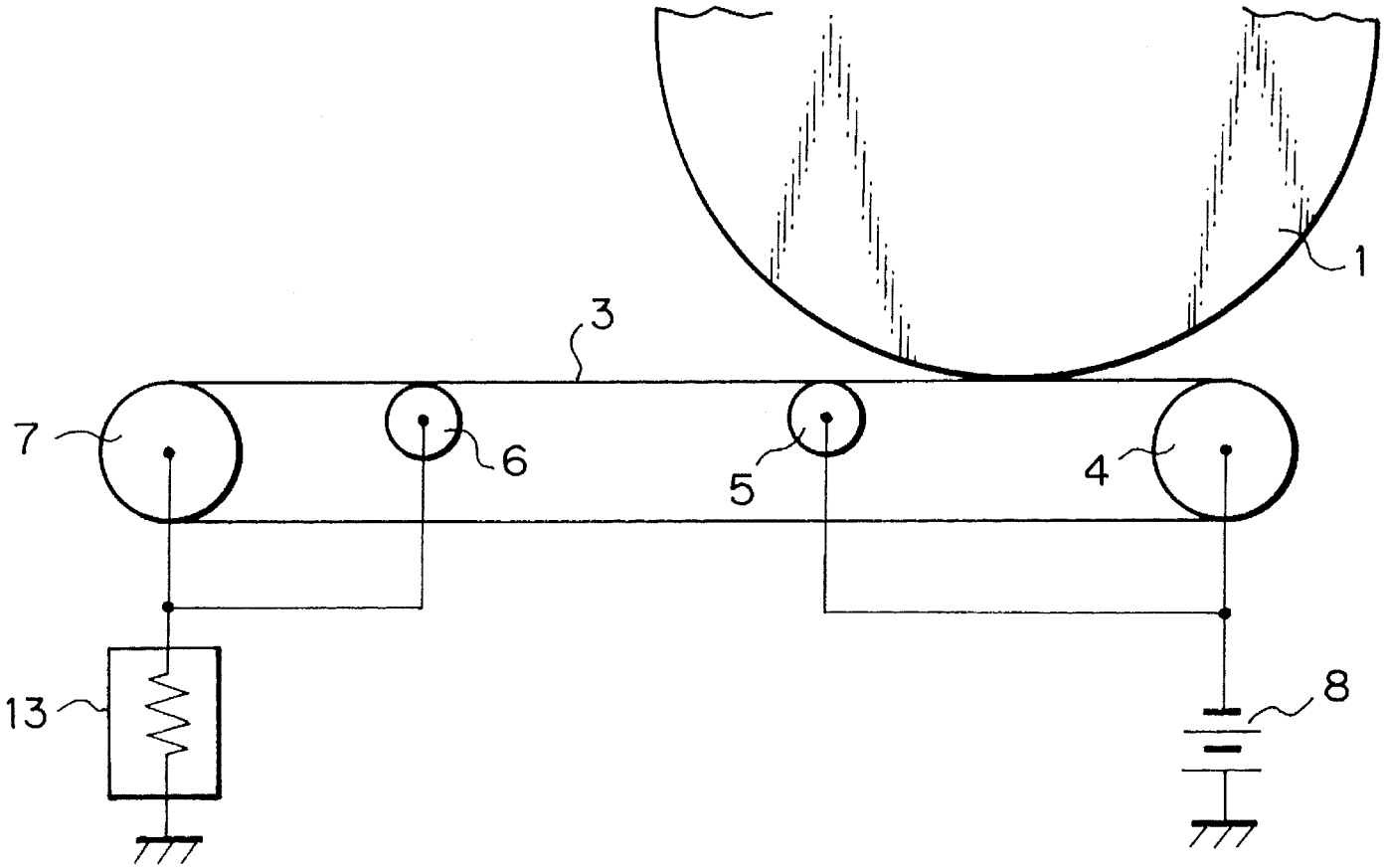
FIG. 1 is a view schematically showing a first embodiment or the image transfer device in accordance with the present invention.

To better understand the present invention, a brief reference will be made to a conventional contact type image transfer device, shown in FIG. 9. The image transfer device shown in the figure is applied to a copier or similar electrophotographic image forming apparatus. As shown, an image carrier in the form of a photoconductive drum 1 is rotated by a drive mechanism, not shown, and uniformly charged by a main charger. A writing device writes image data on the charged surface of the drum 1 to electrostatically form a latent image. A developing device develops the latent image to produce a corresponding toner image. A transfer medium implemented as a sheet is fed from a sheet feed device to a register roller 2. The register roller 2 drives the sheet toward a transfer belt 3 in synchronism with rotation of the drum 1 such that the leading edge of the sheet meets that of the toner image. The transfer belt 3 has at least the front or outer surface thereof made of a dielectric material.

The transfer belt 3 is passed over a drive roller 4 and driven rollers 5–7. The rollers 6 and 7 are connected to ground and serve as electrodes contacting the belt 3. The roller 5 is a bias roller constituting an electrode. The roller 4 plays the role of a bias roller at the same time. When the leading edge of the sheet approaches a position where the drum 1 and belt 3 contact each other, a solenoid 9 is energized to drive a push lever 10. Then, the push lever 10 raises one side of the belt unit including the belt 3 and rollers 4–7 until the belt 3 contacts the drum 1.

The drive roller 4 is rotated by a motor to in turn rotate the belt 3. The belt 3 contacts the drive roller 4 at a position upstream of the position where it contacts the drum 1. The belt 3 contacts the bias roller 5 at a position downstream of the position where it contacts the drum 1. Further, the belt 3 contacts the drum 1 over a predetermined nip width. When the belt 3 is brought into contact with the drum 1, a predetermined bias voltage which is opposite in polarity to the toner deposited on the drum 1 is applied from a high tension power source 8 to each of the bias rollers 4 and 5. The belt 3 is made of a material having a medium specific volume resistance ($10^6$–$10^{12}$ Ω cm). As each of the bias rollers 4 and 5 applies the bias voltage to the belt 3, a current flows toward the rollers 6 and 7 to cause the voltage to fall.

When the sheet moves between the belt 3 and the drum 1, the toner is transferred from the drum 1 to the sheet due to the bias voltage of polarity opposite to the toner on the drum 1. The sheet is polarized by the charge applied from the high tension power source 8 to the drum 3. As a result, an electrostatic force is generated by the polarizing charge of the sheet and the true charge of the belt 3. Hence, the sheet is transported by the belt 3 by being electrostatically adhered to the belt 3. While the sheet is in transport, the charge thereof is released to ground via the belt 3 having medium resistance and the rollers 6 and 7. Consequently, the charge deposited on the sheet is sequentially reduced. The rate of decrease in the charge of the sheet is greatly dependent on the resistance R and electrostatic capacitance C of the sheet and is generally represented by a time constant $\tau=R\cdot C$. Then, the sheet is transported by the belt 3 toward a fixing device having a fixing roller. In a position close to the inlet of the fixing device, the charge of the sheet and, therefore, the electrostatic force acting between the sheet and the belt 3 is reduced. The sheet is separated from the belt 3 due to the curvature of the roller 7 and the elasticity of the sheet. The fixing device fixes the toner image on the sheet. Preferably, the roller 7 has a diameter of 14–16 min.

As soon as the trailing edge of the sheet moves away from the nip portion between the drum 1 and the belt 3, the solenoid 9 is deenergized. As a result, the push lever 10 and, therefore, the belt unit including the belt 3 and rollers 4–7 are restored to the original positions, whereby the belt 3 is spaced apart from the drum 1. This is successful in protecting the drum 1 from deterioration ascribable to the frictional contact of the belt 3 and drum 1 when the transfer of a toner image is not being performed.

During the image transfer, some toner is scattered around without being transferred from the drum 1 to the sheet and is directly deposited on the belt 3. The rollers 6 and 7 connected to ground reduce the charge of the residual toner, and then a cleaning blade 11 scrapes off the toner from the belt 3 while letting it fall into a collecting bottle 12.

The conventional image transfer device having the above construction reduces ozone and required power source voltage, compared to a corona type image transfer device, as discussed earlier. However, the problem with the transfer belt 3 is that the adequate voltage to be applied from the power source 8 to the belt 3 changes due to irregularity in the resistance of the belt 3 and changes in ambient conditions, transfer medium type, area of a toner image and so forth, thereby obstructing adequate image transfer. Specifically, the amount of charge to deposit on the belt 3 in response to the voltage from the power source 8 deviates from a value necessary for adequate image transfer due to irregularity in the resistance of the belt 3 particular to the production line, changes in the resistance ascribable to the varying environment, changes in the material and thickness of the recording medium, etc. Among them, the changes in the resistance of the belt 3 ascribable to the production line and environment may be reduced by elaborating the production line. This, however, severely restricts the specifications and, therefore, reduces the yield and increases the cost of the belt 3. It follows that an image transfer device desirably operable despite some irregularity in the resistance of the belt 3 is needed. Particularly, when the resistance of the belt 3 is lowered, a greater current flows to ground via the drive roller and other rollers contacting the belt 3 than to the drum 1 via the electrodes, obstructing desirable image transfer.

Referring to FIG. 1 of the drawings, a first embodiment of the image transfer device in accordance with the present invention is shown. As shown, the device has a resistance element 13 between the rollers 6 and 7 and ground included in the contact type arrangement of FIG. 9. A high tension power source 8 applies a predetermined voltage $V_1$ to a transfer belt 3 via bias rollers 4 and 5 so as to transfer a toner image from a photoconductive drum 1 to a sheet carried on the belt 3. At this instant, an output current $A_1$ fed from the power source 8 via the bias rollers 4 and 5 is divided into a current $A_2$ flowing from the belt 3 to ground via the rollers 6 and 7, and a current $A_3$ flowing from the belt 3 to the drum 1.

While in the above embodiment the resistance element 13 has a resistance of 10 MΩ, the intended effect is achievable if the resistance ranges from 5–50 MΩ, preferably $10^6$–$10^8$ Ω. FIG. 2 tabulates changes in the voltage $V_1$ and currents $A_1$, $A_2$ and $A_3$ resulting from resistances of $10^6$Ω, $10^7$ Ω and $10^8$ Ω (rear surface resistance or specific resistance of the belt 3) and particular to the embodiment using the resistance element 13 of 10 MΩ and the conventional device of FIG. 9 lacking it. Here, the front surface of the belt 3 is treated with fluorine to have a resistance of substantially $10^{12}$ Ω. Assume that the predetermined voltage $V_1$ is applied from the power source 8 to the belt 3 via the bias rollers 4 and 5, and that the resistance of the belt 3 is as low as $10^6$ Ω. Then, as FIG. 2 indicates, the conventional device shown in FIG. 9 cannot be used since an excessive current flows. By contrast, the above embodiment according to the present invention is operable even when the belt 3 has a significantly low resistance due to the action of the resistance element 13.

Figure 3:
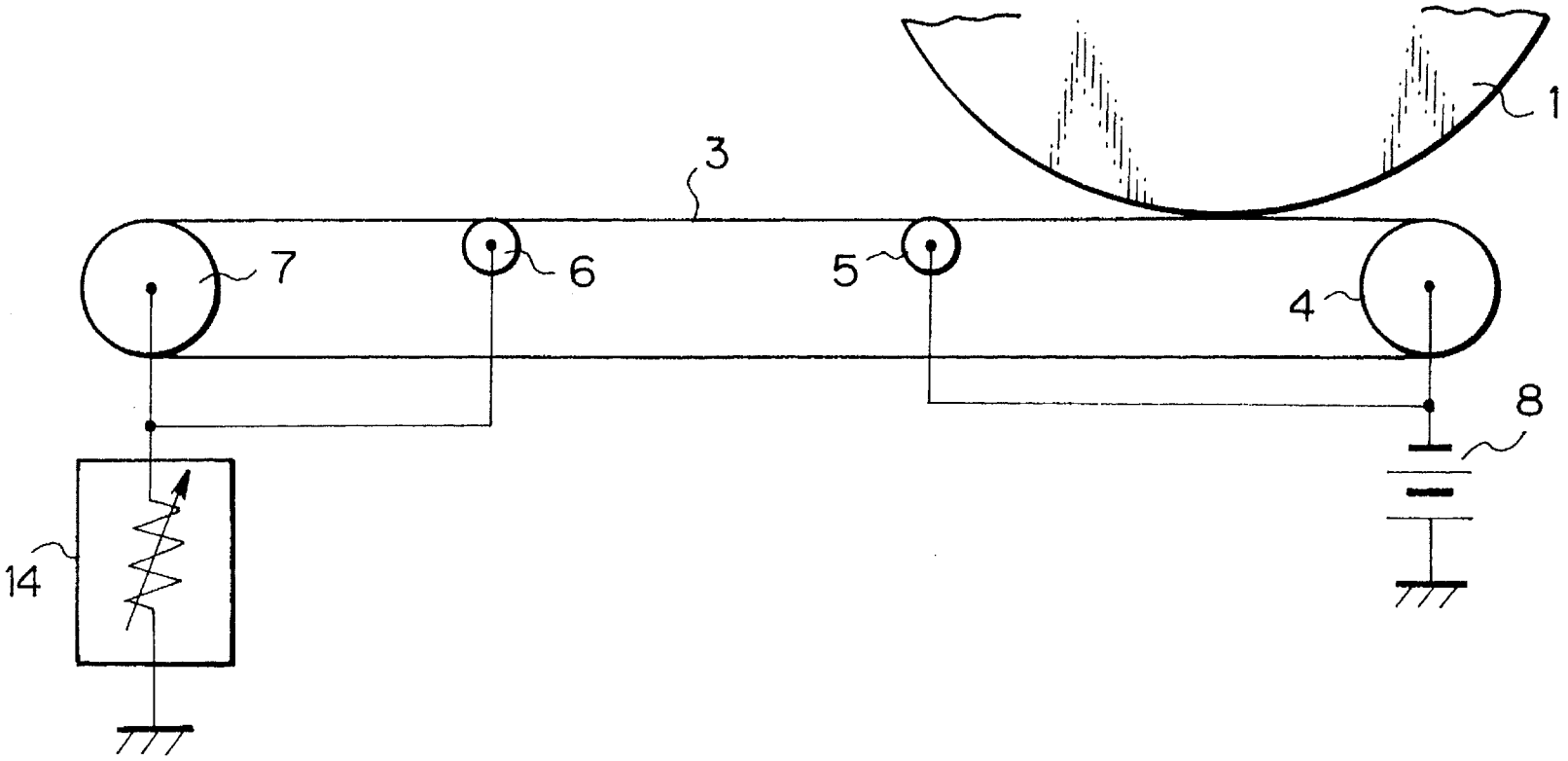
FIG. 3 is a view schematically showing a second embodiment of the present invention.

Referring to FIG. 3, a second embodiment of the present invention will be described. This embodiment is essentially similar to the previous embodiment except that a variable resistance element 14 is substituted for the resistance element 13. The variable resistance element 14 is connected between the roller 7 and ground and is adjusted to a desired resistance only when needed. With the resistance element 14, the embodiment shown in FIG. 3 achieves the same advantage as the previous embodiment and is particularly effective when the resistance of the transfer belt 3 is low. Conversely, when the resistance of the belt 3 is high, the voltage $V_1$ and currents $A_1$, $A_2$ and $A_3$ do not differ from the case with the resistance element 14 to the case without it; rather, the resistance element 14 prevents the potential of the roller 7 from reaching 0 V and thus causing the leak to ground and electrostatic noise. Next, a charge is deposited on the sheet separated from the belt 3 which is greater than that deposited when the potential of the roller 7 is 0 V. This is apt to cause the charge of the sheet to charge the fixing roller of the fixing device, thereby lowering this fixing ability. For this reason, the embodiment controls the resistance of the resistance element 14 to a desired value only when needed.

Figure 4:
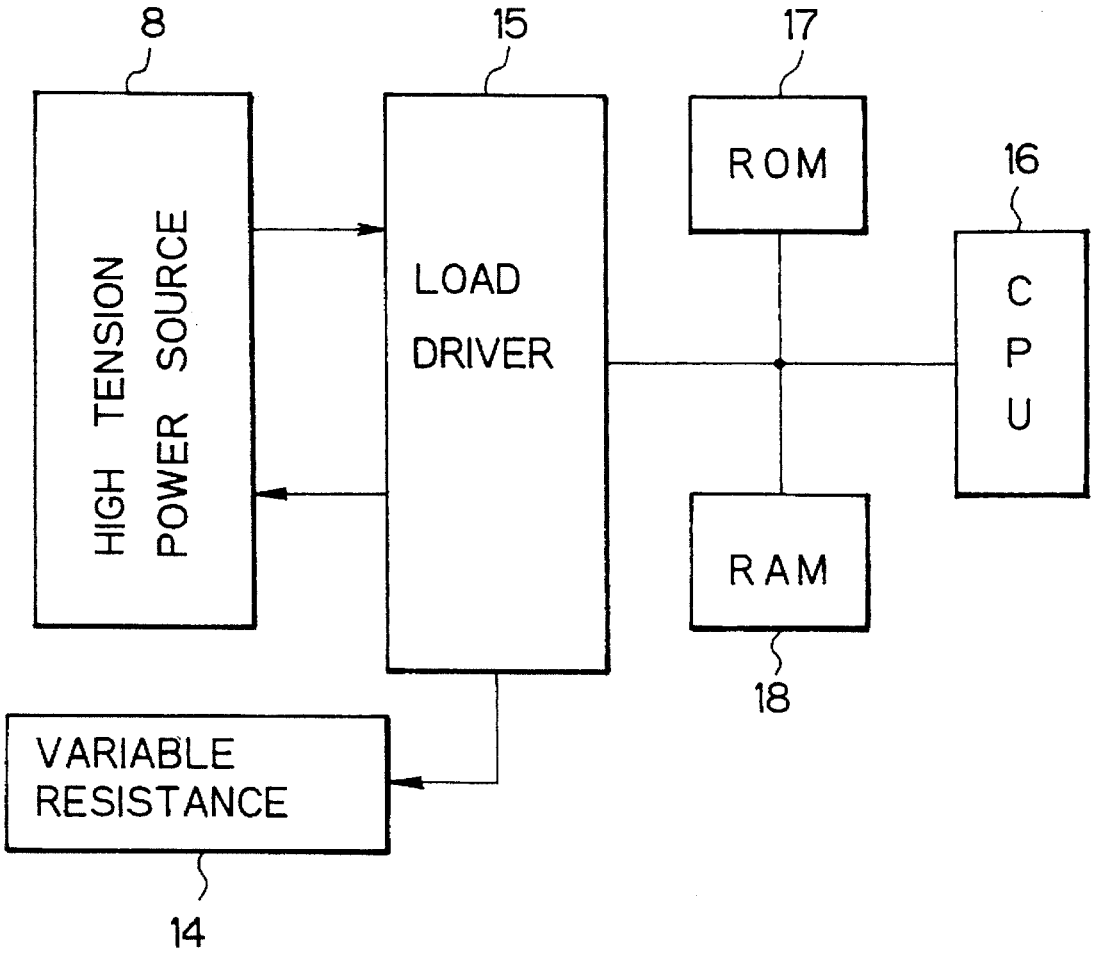
FIG. 4 is a schematic block diagram showing a control circuit with which the second embodiment is practicable.

FIG. 4 schematically shows a control circuit included in the second embodiment. As shown, a microcomputer has a CPU (Central Processing Unit) 16, a ROM (Read Only Memory) 17 and a RAM (Random Access Memory) 18 and controls the high tension power source 8 via a load driver 15 in the same manner as in the conventional device of FIG. 9. The load driver 15 detects the voltage $V_1$ and output current $A_1$ of the power source 8 and produces a ratio of the former to the latter, i.e., V/μA. If the ratio V/μA is lower than 10, the microcomputer raises the resistance of the variable resistance element 14 from zero. As a result, the ratio V/μA is prevented from decreasing to a value below 10. The resistance element 14 can have the resistance thereof changed over a range from zero to $10^8$ Ω.

In a third embodiment, the load driver 15 of the second embodiment controls the variable resistance element 14 on the basis of a ratio of the output current $A_1$ of the power source 8 to the current $A_2$ flowing from the belt 3 to ground via the rollers 6 and 7, i.e., $A_1/A_2$. Specifically, in this embodiment, the load driver 15 detects the currents $A_1$ and $A_2$, produces a ratio $A_1/A_2$, and then raises the resistance of the resistance element 14 such that the ratio $A_1/A_2$ does not decrease to below 1.07.

Figure 5:
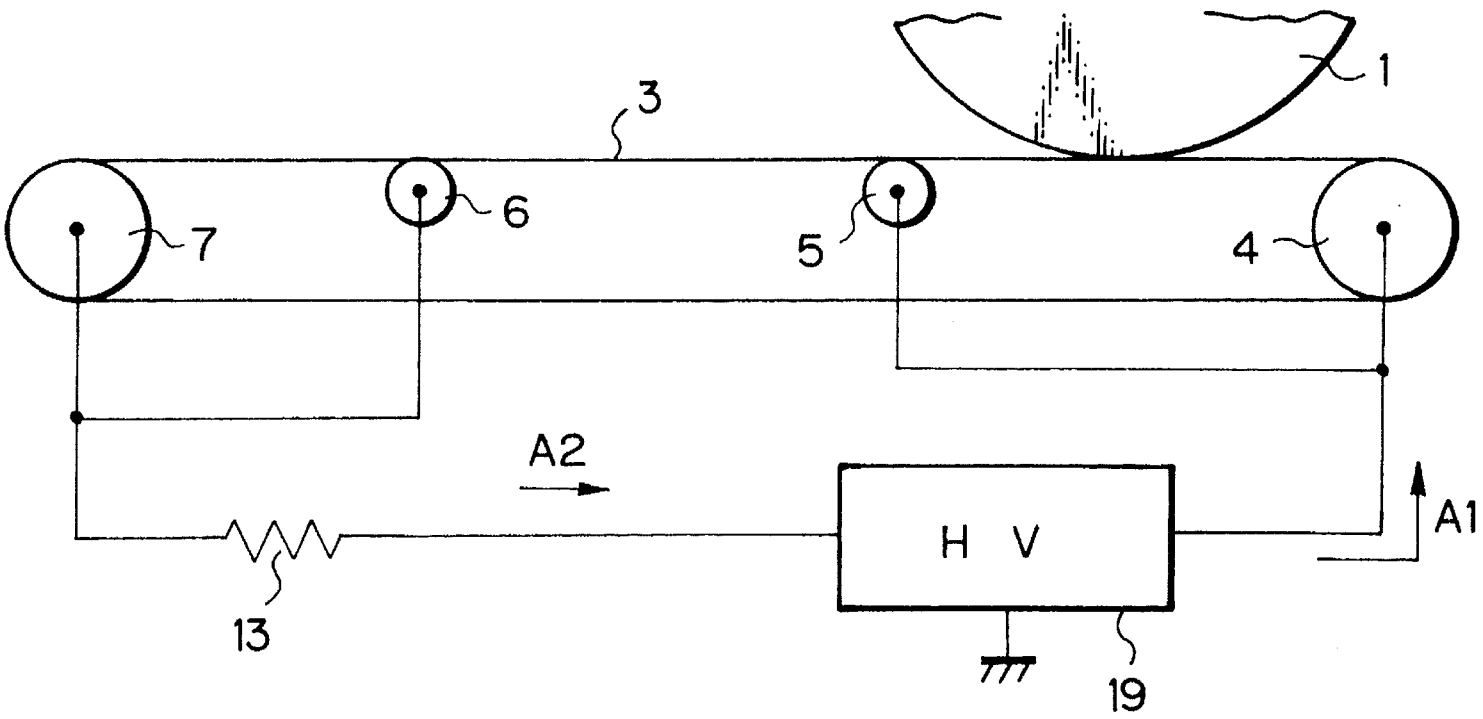
FIG. 5 is a view schematically showing a fourth embodiment of the present invention.

A fourth embodiment of the present invention will be described with reference to FIG. 5. As shown, this embodiment is similar to the first embodiment except that the high tension power source 8 is implemented as a high tension power source (HV) 19 whose output current $A_1$ changes in response to a feedback current. Specifically, the current $A_2$ flowing from the roller 7 to ground via the resistance element 13 is fed back to the high tension power source 19. The output current $A_1$ of the power source 19 changes such that the difference between the current $A_2$ and the output current $A_1$ has a constant value $A_3$ ($=A_1-A_2$). By so controlling the output current $A_1$ of the power source 19, this embodiment insures a stable image transfer characteristic at all times with no regard to the environment, type of sheet used, or the resistance of the belt 3.

Figure 7:
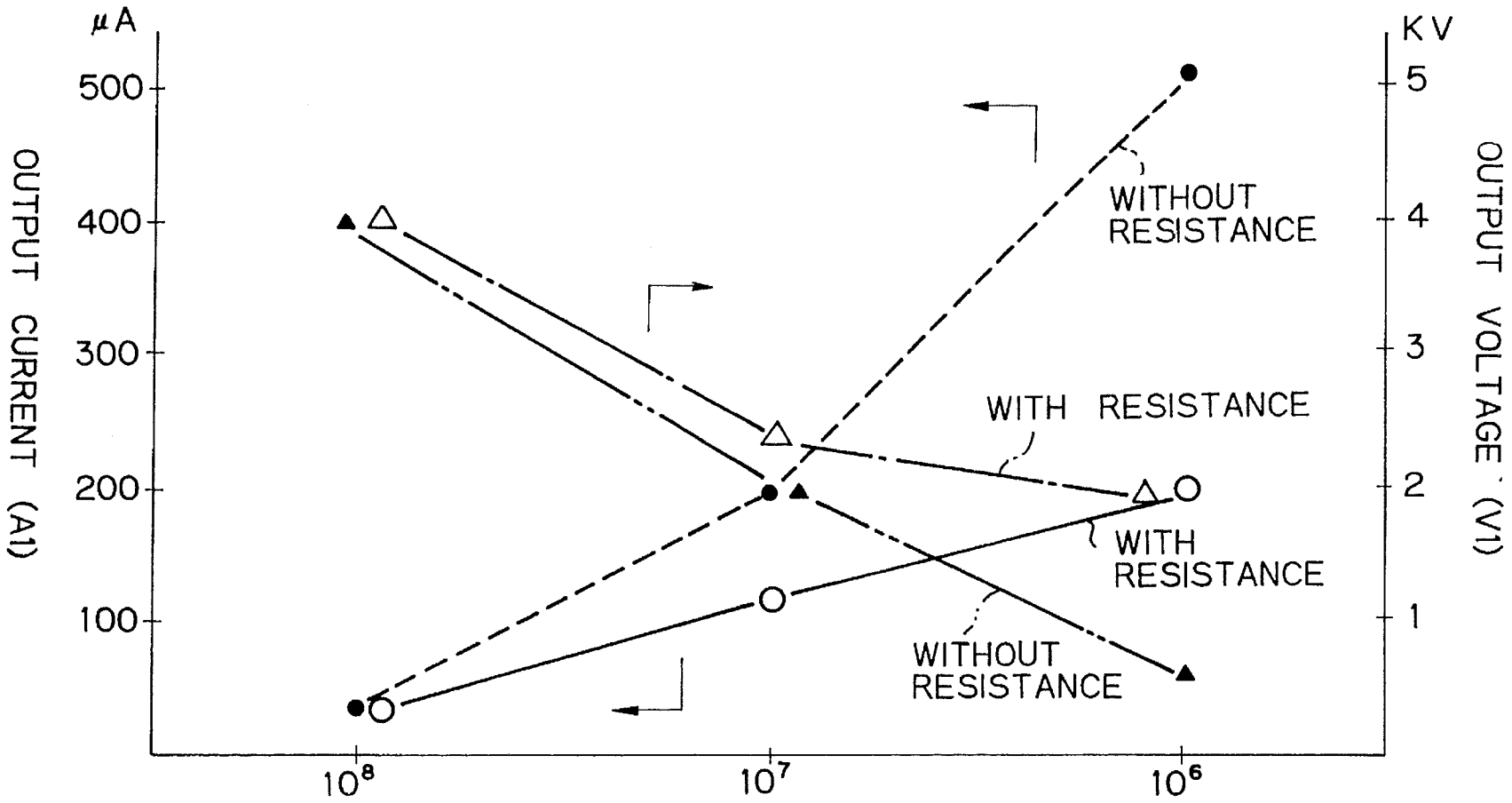
FIG. 7 is a graph indicative of a relation between the output voltage and the output current of a high tension power source included in the fourth embodiment.
Figure 9:
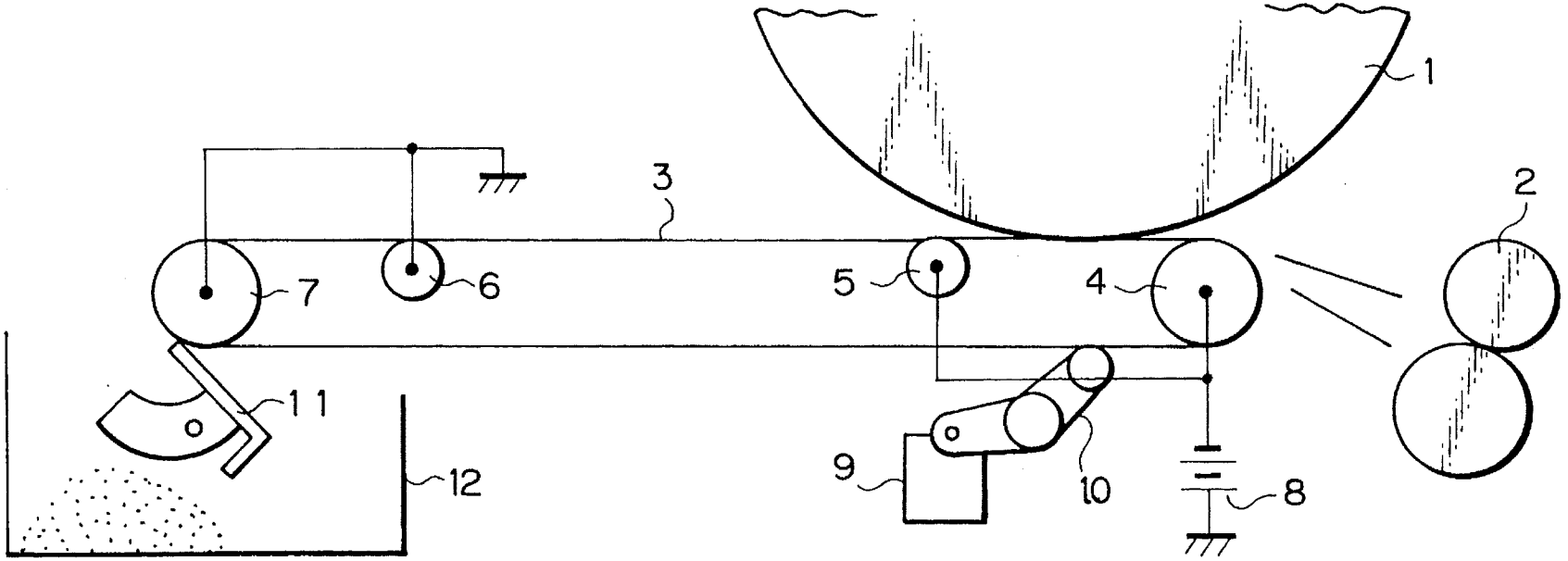
Fig. 9 PRIOR ART
FIG. 9 is a schematic view showing the conventional contact type image transfer device.

FIG. 6 tabulates changes in the voltage $V_1$ and currents $A_1$, $A_2$ and $A_3$ resulting from resistances of $10^6$ Ω, $10^7$ Ω and $10^8$ Ω (rear surface resistance or specific resistance of the belt 3) and particular to the fourth embodiment using the resistance element 13 of 10 MΩ and the conventional device of FIG. 9 lacking it. FIG. 7 shows a relation between the output voltage $V_1$ and the output current $A_1$ of the high tension power source 19. As FIGS. 6 and 7 indicate, the present invention is capable of reducing changes in the current $A_1$ and voltage $V_1$ even when the rear surface resistance of the belt 3 irregular. Particularly, when the rear surface resistance of the belt 3 is lowered to thereby noticeably lower the voltage $V_1$ from the power source 19, it is likely with the conventional device that the electric field for image transfer will be too low to make the image transfer defective although a current necessary for image transfer may be obtained. In the illustrative embodiment, the resistance element 13 improves this point.

Figure 8:
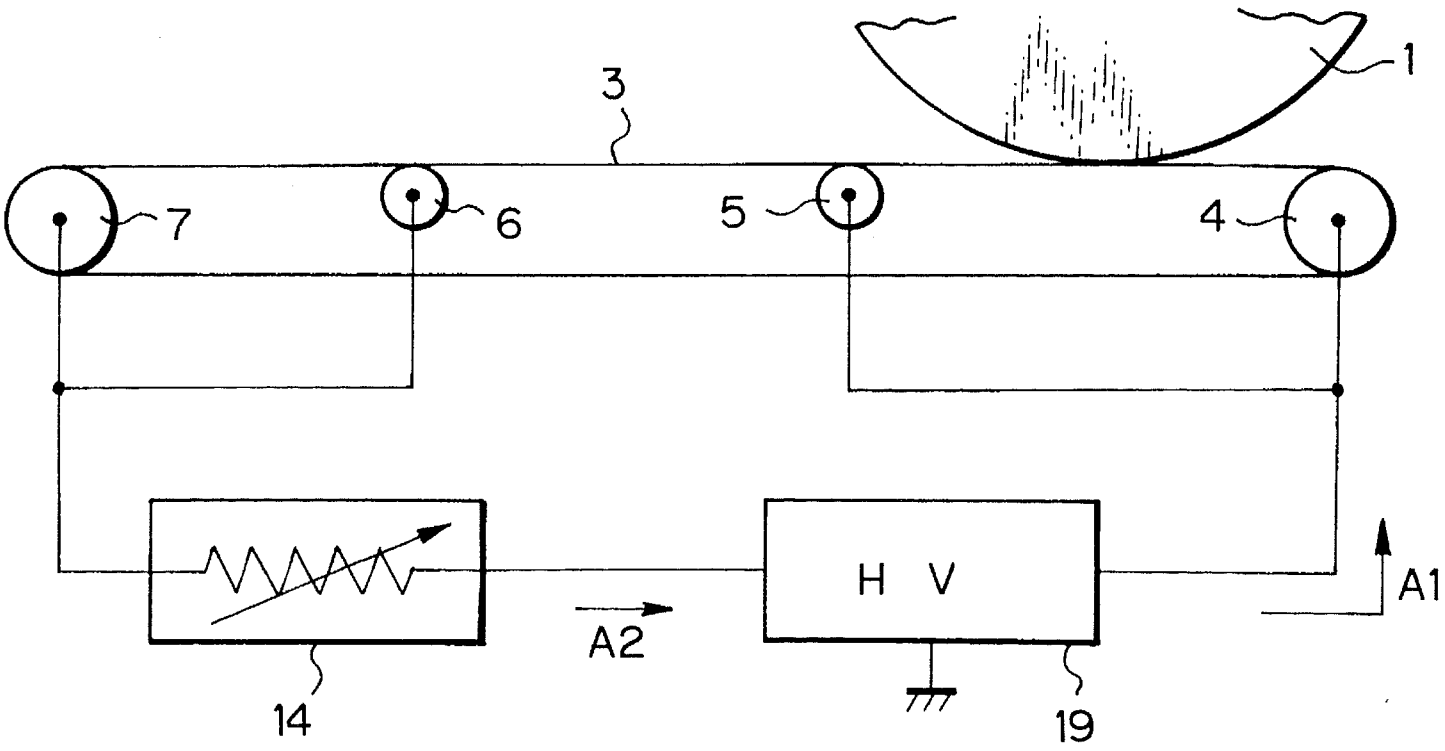
FIG. 8 is a view schematically showing a fifth embodiment of the present invention.

FIG. 8 shows a fifth embodiment which is similar to the fourth embodiment except that the variable resistance element 14 is substituted for the resistance element 13, and in that the resistance of the variable resistance element 14 is controlled to a desired value only when needed. The fifth embodiment, like the second embodiment, is implemented with the circuitry shown in FIG. 4. The high tension power source 8 is controlled by the microcomputer made up of the CPU 16, ROM 17 and RAM 18 as in the second embodiment and in the same manner as in the conventional device of FIG. 9. The load driver 15 detects the voltage $V_1$ and output current $A_1$ of the power source 8, produces a ratio V/μA, and then increases the resistance of the variable resistance element 14 from zero when the ratio V/μA decreases to below 10.

Assume that the output current A1 of the high tension power source 19 is controlled such that A1−A2=A3 holds. Then, particularly when the rear surface resistance of the transfer belt 3 decreases, the feedback current A2 easily flows from the roller 7 to the power source 19 via the resistance element 13. As a result, the output current A1 of the power source 19 increases to cause the constant current A3 for image transfer to flow, resulting in leak or scaling up the power source 19. The resistance element 13 is successful in eliminating this problem.

A sixth embodiment of the present invention is similar to the fifth embodiment except that the load driver 15 controls the variable resistance element 14 on the basis of a ratio of the output current $A_1$ of the high tension power source 8 to the current $A_2$ flowing from the belt 3 to ground via the rollers 6 and 7. Specifically, the embodiment detects currents $A_1$ and $A_2$, produces a ratio $A_1/A_2$, and then increases the resistance of the resistance element 14 from zero to maintain the ratio $A_1/A_2$ above 1.07.

In summary, it will be seen that the present invention provides an image transfer device which insures stable image transfer even with a transfer belt having a relatively low resistance. The transfer belt, therefore, can be selected from a broad range of specifications, reducing the cost and enhancing the reliability of the device. When the transfer belt has a high resistance, the resistance can be lowered to maintain the potential of an electrode connecting the belt to ground low. This eliminates charge leak and electrostatic noise. Further, the device of the invention eliminates an occurrence that on the fall of the resistance of the belt, a voltage applied from a power source to a first electrode drops to make an electric field for image transfer short and thereby degrades image transfer.

Various modifications will become possible for those skilled in the art after receiving the teachings of the present disclosure without departing from the scope thereof.

What is claimed is:

1. An image transfer device in which a transfer belt is rotated and applied with a charge from a first electrode in contact with said transfer belt to transfer a toner image from an image carrier to a transfer medium carried on said transfer belt, said device comprising:

a second electrode contacting said transfer belt; and a resistance element connected between said second electrode and ground, wherein said resistance element comprises a variable resistance element, said device further comprising control means for producing a ratio of a voltage applied from the first electrode to said transfer belt to an output current from said first electrode to said transfer belt and for controlling a resistance of said variable resistance element such that said ratio has a predetermined value.

2. An image transfer device in which a transfer belt is rotated and applied with a charge from a first electrode in contact with said transfer belt to transfer a toner image from an image carrier to said transfer belt, said device comprising:

a second electrode contacting said transfer belt; and a resistance element connected between said second electrode and ground, wherein said resistance element comprises a variable resistance element, said device further comprises control means for producing a ratio of a voltage applied from the first electrode to said transfer belt to an output current from said first electrode to said transfer belt and for controlling a resistance of said variable resistance element such that said ratio has a predetermined value.

3. An image transfer device in which a transfer belt is rotated and applied with a charge from a first electrode in contact with said transfer belt to transfer a toner image from an image carrier to a transfer medium carried on said transfer belt, said device comprising:

a second electrode contacting said transfer belt; and a resistance element connected between said second electrode and ground, wherein said resistance element comprises a variable resistance element, said device further comprising control means for producing a ratio of an output current from the first electrode to said transfer belt and a current from said transfer belt to said second electrode and for controlling a resistance of said variable resistance element such that said ratio has a predetermined value.

4. An image transfer device in which a transfer belt is rotated and applied with a charge from a first electrode in contact with said transfer belt to transfer a toner image from an image carrier to said transfer belt, said device comprising:

a second electrode contacting said transfer belt; and a resistance element connected between said second electrode and ground, wherein said resistance element comprises a variable resistance element, said device further comprising control means for producing a ratio of an output current from the first electrode to said transfer belt and a current from said transfer belt to said second electrode, and for controlling a resistance of said variable resistance element such that said ratio has a predetermined value.

5. A method for forming images, comprising:

rotating an image transfer belt;

maintaining a first electrode in contact with said image transfer belt;

applying a charge to said image transfer belt from a power source via said first electrode;

feeding back a current from said image transfer belt to said power source via a second electrode which also contacts said image transfer belt;

controlling a ratio of a voltage applied from the first electrode to said transfer belt to an output current from the first electrode to said transfer belt; and controlling the resistance of a variable resistance element such that said ratio has a predetermined value.

6. The method according to claim 5, further comprising:

setting a variable resistance between said second electrode and said power source; and controlling the ratio of a voltage applied from the first electrode to the transfer belt to an output current from said first electrode to said transfer belt such that said ratio has a predetermined value.

7. The method according to claim 5, further comprising:

setting a variable resistance between said second electrode and said power source; and controlling the ratio of an output current from the first electrode to said transfer belt and a current from said transfer belt to said second electrode such that said ratio has a predetermined value.

8. An image transfer device in which a transfer belt is rotated and applied with a charge from a first electrode in contact with said transfer belt to transfer a toner image from an image carrier to a transfer medium carried on said transfer belt, said device comprising:

a second electrode contacting said transfer belt; and a resistance element connected between said second electrode and ground, wherein a ratio of a resistance of said transfer belt to a resistance of said resistance element is one of 1:1–100 and 10:1–100 and 100:1–100.

9. A device as claimed in claim 8, wherein the resistance of said transfer belt is a rear surface resistance of said belt contacting said second electrode.

10. A device as claimed in claim 8, wherein said resistance element has an electric resistance ranging from $10^6$ Ω to $10^8$ Ω.

11. A device as claimed in claim 10, wherein said resistance element comprises a fixed resistance element.

12. A device as claimed in claim 8, wherein said resistance element has an electric resistance higher than a minimum electric resistance belonging to a predetermined electric resistance range particular to said belt.

13. A device as claimed in claim 12, wherein said resistance element comprises a fixed resistance element.

* * * * *